US007671729B2

(12) United States Patent
Hershkovitz et al.

(10) Patent No.: US 7,671,729 B2
(45) Date of Patent: Mar. 2, 2010

(54) SYSTEM AND A METHOD FOR REMOTE MONITORING CUSTOMER SECURITY SYSTEMS

(75) Inventors: Shmuel Hershkovitz, 53 Fortune Bay Inlet, Freeport (BS); Louis Roy, Montréal (CA); Martin Beaulieu, Terrebonne (CA); Pascal Turcotte, Deux-Montagnes (CA); Jean-François Poirier, Deux-Montagnes (CA)

(73) Assignee: Shmuel Hershkovitz, Freeport (BS)

( * ) Notice: Subject to any disclaimer, the term of this patent is extended or adjusted under 35 U.S.C. 154(b) by 559 days.

(21) Appl. No.: 11/559,666

(22) Filed: Nov. 14, 2006

(65) Prior Publication Data

US 2008/0111683 A1 May 15, 2008

(51) Int. Cl.
*G08B 1/00* (2006.01)

(52) U.S. Cl. ..... 340/531; 340/540; 340/5.3; 340/5.33; 348/143

(58) Field of Classification Search ..... 340/531, 340/541, 540, 565, 539.22, 5.1, 5.2, 5.3, 340/5.33, 5.64, 286.02; 348/143, 152, 161
See application file for complete search history.

(56) References Cited

U.S. PATENT DOCUMENTS 6,741,171 B2 * 5/2004 Palka et al. ..... 340/501
6,829,478 B1 * 12/2004 Layton et al. ..... 455/428
6,930,599 B2 * 8/2005 Naidoo et al. ..... 340/539.1
7,015,806 B2 * 3/2006 Naidoo et al. ..... 340/531
7,016,813 B2 * 3/2006 Alexander et al. ..... 702/188

* cited by examiner

*Primary Examiner*—Toan N Pham
(74) *Attorney, Agent, or Firm*—Sterne, Kessler, Goldstein & Fox, PLLC

(57) ABSTRACT

There is provided a system for remote monitoring a plurality of security systems connected to the Internet, the security systems being assigned dynamic IP addresses, each of the security systems comprising a remote monitoring server module, the system comprising a central alarm monitoring service connected to the Internet for periodically communicating with the plurality of security systems and determining a status thereof to generate an alarm signal as a function of the status, the alarm monitoring service storing a current IP address of the plurality of security systems in an IP address database, and a remote monitoring gateway providing authenticated or unauthenticated dynamic domain name service (DDNS) server functionality to connect a given remote monitoring client to a desired one of the security systems, the gateway being connected to the IP address database and to the Internet. There is further provided a method of remote monitoring a security system.

16 Claims, 3 Drawing Sheets

SYSTEM AND A METHOD FOR REMOTE MONITORING CUSTOMER SECURITY SYSTEMS

FIELD OF THE INVENTION

The present invention relates to a method and a system for remote monitoring customer security systems.

BACKGROUND OF THE INVENTION

Generally, electronic devices connected to the Internet are assigned dynamic IP addresses by their ISP's, as it is customary. In order to communicate with a desired device, the transmitter should have knowledge of the current IP address thereof at the moment of the transmission. Traditionally, Dynamic Domain Name Service (DDNS) has been used to track current IP addresses of Internet connected devices having dynamic IP addresses. Using this service can require from the user to regularly access and program his Internet connected device to suite the Internet connection. This can be inconvenient for the user. Besides, it can be inconvenient, for security reasons, to certain companies providing certain type of services to give such an option to the user.

SUMMARY OF THE INVENTION

It is therefore an object of the present invention to provide a system and a method for remote monitoring customer security systems that would overcome the aforementioned drawbacks.

According a first aspect of the invention, there is provided a system for remote monitoring a plurality of security systems connected to the Internet, the security systems being assigned dynamic IP addresses, each of the security systems comprising a remote monitoring server module, the system comprising:

- a central alarm monitoring service connected to the Internet for periodically communicating with the plurality of security systems and determining a status thereof to generate an alarm signal as a function of the status, the alarm monitoring service storing a current IP address of the plurality of security systems in an IP address database;
- a remote monitoring gateway providing authenticated or unauthenticated dynamic domain name service (DDNS) server functionality to connect a given remote monitoring client to a desired one of the security systems, the gateway being connected to the IP address database and to the Internet.

As a further aspect of the invention, there is provided a system for remote monitoring a plurality of security systems connected to the Internet, the security systems being assigned dynamic IP addresses, each of the security systems comprising a remote monitoring server module, in which the system comprises in combination a billing module, a central alarm monitoring service module and a remote monitoring gateway. The billing module stores client account data. The central alarm monitoring service module is connected to the billing module for receiving the client account data, the module using the account data for control of the alarm monitoring. The remote monitoring gateway provides authenticated or unauthenticated dynamic domain name service (DDNS) server functionality to connect a given remote monitoring client among the plurality of remote monitoring clients to a desired one of the security systems. The gateway is connected to the Internet and to an IP address database storing a current IP address associated with each one of the plurality of security systems, the gateway being connected to the billing module to receive the client account data, the gateway using the client account data to control the DDNS.

The systems preferably further comprises an account database connected to the gateway for verifying an account status of the remote monitoring client, the gateway taking a decision whether or not to connect the remote monitoring client to the desired one of the security systems as a function of the account status.

The system preferably further comprises a plurality of remote monitoring client modules associated with the plurality of remote monitoring clients, the remote monitoring client modules being connected to the Internet for accessing the security systems.

The plurality of security systems preferably further comprise a status push module, the communicating is preferably carried out by periodically transmitting from the status push module to the central alarm monitoring service a status signal in connection with the plurality of security systems, and the determining the status is preferably carried out at the central alarm monitoring service as a function of the received status signal.

The plurality of security systems preferably further comprise a DDNS client module to detect a change of the dynamic IP address upon occurrence, the plurality of security systems transmitting, upon occurrence of the change, the current IP address to the central alarm monitoring service.

The plurality of security systems preferably transmit periodically a signal comprising the current IP address to the central alarm monitoring service.

The determining the status is preferably carried out as a function of receiving or lack thereof of the signal at the central alarm monitoring service.

The remote monitoring server module preferably comprises a Web server for accessing the security systems.

As a further aspect of the invention, there is provided a method of remote monitoring a plurality of security systems connected to the Internet, the security systems being assigned dynamic IP addresses, the security systems including a remote monitoring server module, the method comprising:

- providing a central alarm monitoring service connected to the internet for periodically communicating with the plurality of security systems and determining a status thereof to generate an alarm signal as a function of the status, the alarm monitoring service storing a current IP address of the plurality of security systems in an IP address database; and
- providing a remote monitoring gateway providing authenticated or unauthenticated dynamic domain name service (DDNS) server functionality to connect a given remote monitoring client to a desired one of the security systems, the gateway being connected to the IP address database and to the Internet.

The method preferably further comprises verifying an account status of the remote monitoring client and taking a decision whether or not to connect the remote monitoring client to the desired one of the security systems as a function of the account status.

The method preferably further comprises billing the remote monitoring client for providing the dynamic domain name service.

DETAILED DESCRIPTION OF THE INVENTION

There is provided a system for remote monitoring a security system. The system comprises a plurality of customer security systems 10, a central alarm monitoring service 24, a plurality of remote monitoring client modules 20, and a remote monitoring gateway 22.

Figure 1:
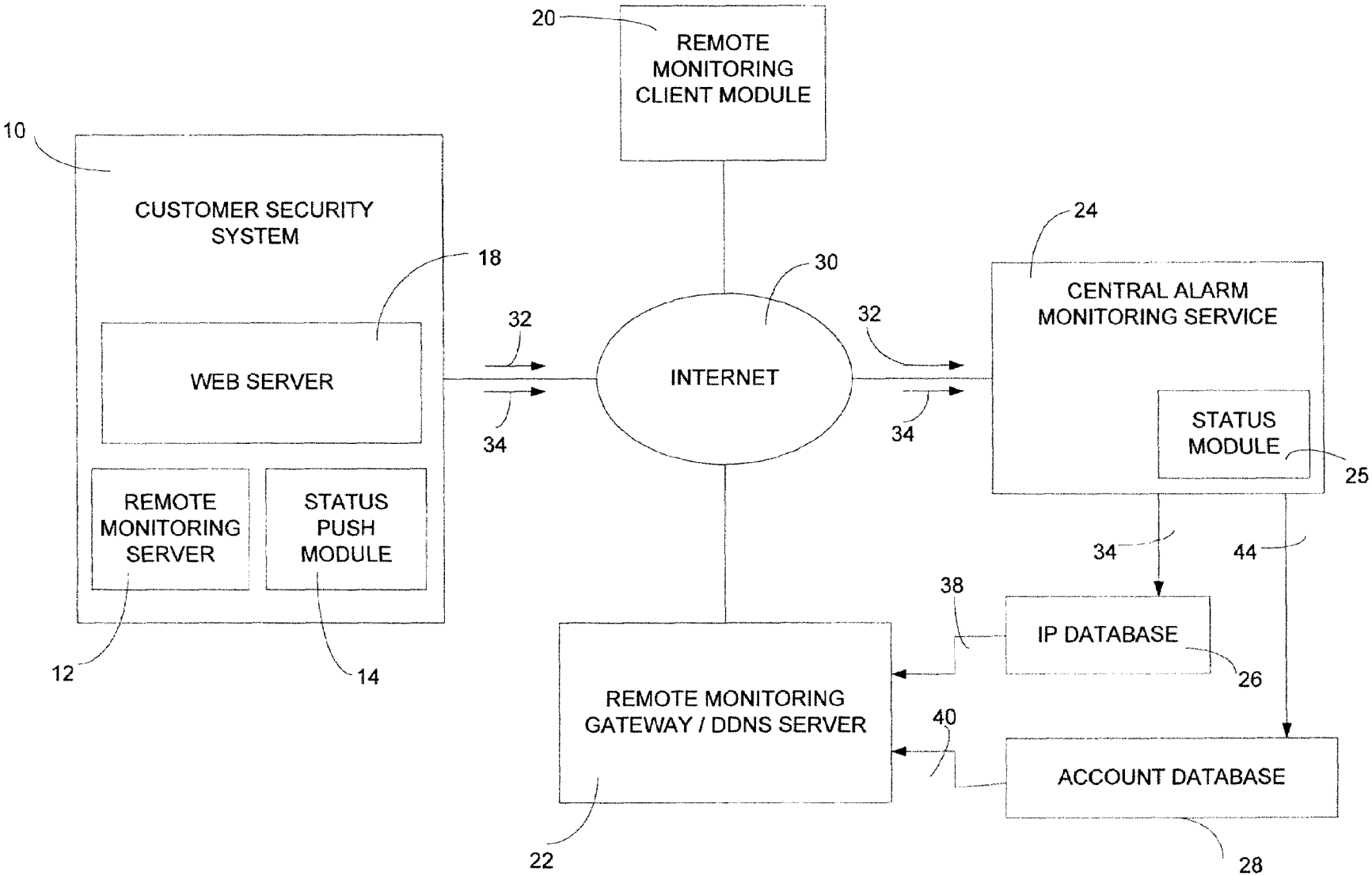
FIG. 1 shows a block diagram of a system for remote monitoring a customer security system using the Internet to communicate the status signal to the central alarm monitoring service, and using a status push module to communicate the current IP address to the central alarm monitoring service.

The customer security systems 10 (although only one is shown in FIG. 1, it is to be understood that many are in use within the network) comprise a remote monitoring server module 12, a status push module 14 (or a DDNS client module 16), and a Web server 18. The remote monitoring server module 12 is provided in software that is executed by the microcontroller or CPU of the customer premises security system control system 10. In some embodiments, this software acts as an http server providing html pages containing the status of the alarm system.

Figure 2:
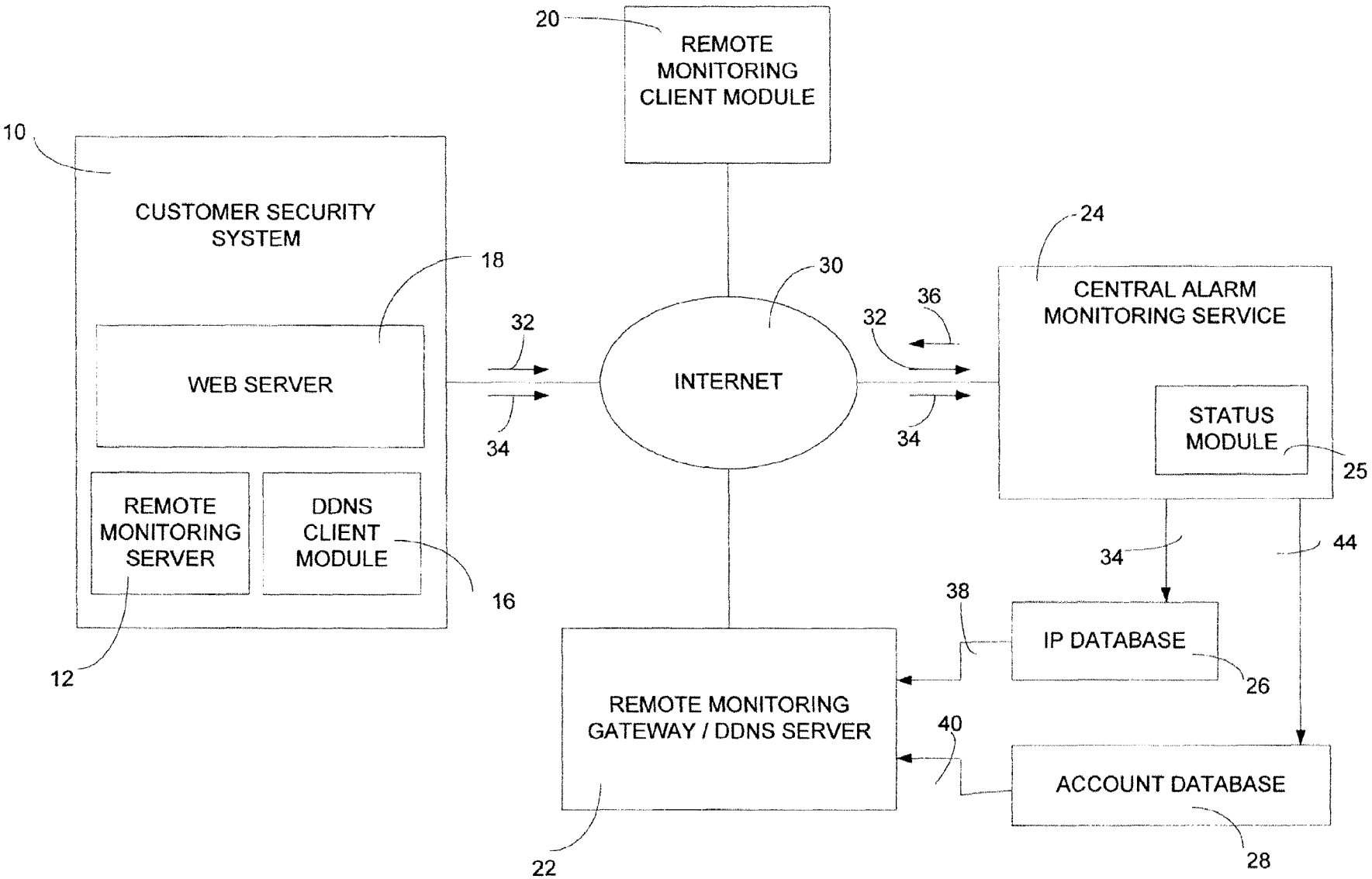
FIG. 2 shows a block diagram of a system for remote monitoring a customer security system using the Internet to communicate the status signal to the central alarm monitoring service, and using a DDNS client module to communicate the current IP address to the central alarm monitoring service.

According to a first embodiment of the invention, the customer security systems 10 are connected to the central alarm monitoring service 24 via the Internet 30 using the IP communication protocol (see FIGS. 1 and 2). However, according to a second embodiment of the invention, the customer security systems 10 are connected to the central alarm monitoring service 24 using another telecommunication medium 50, such as a fixed telephone connection, wireless communication or cable network connection. The telecommunication medium 50 can also be provided as a supplement to the Internet connection.

The customer security systems 10 are configured to detect a security breach, when it occurs. According to a first possible method, the customer security systems 10 comprise a status push module 14 to transmit to the central alarm monitoring service 24 a status signal 32, either periodically or when a status change warrants, as for example an alarm condition detection. The central alarm monitoring service 24 comprises a status module 25 to receive the status signal 32. In one embodiment of the invention, the status module 25 can also transmit a status request signal 36 to the customer security systems 10 requesting for the status. The status signal 32 indicates whether the customer security system 10 has or not detected a security breach. This is a polling mode in which the status information is pulled from the systems 10 by service 24.

Figure 3:
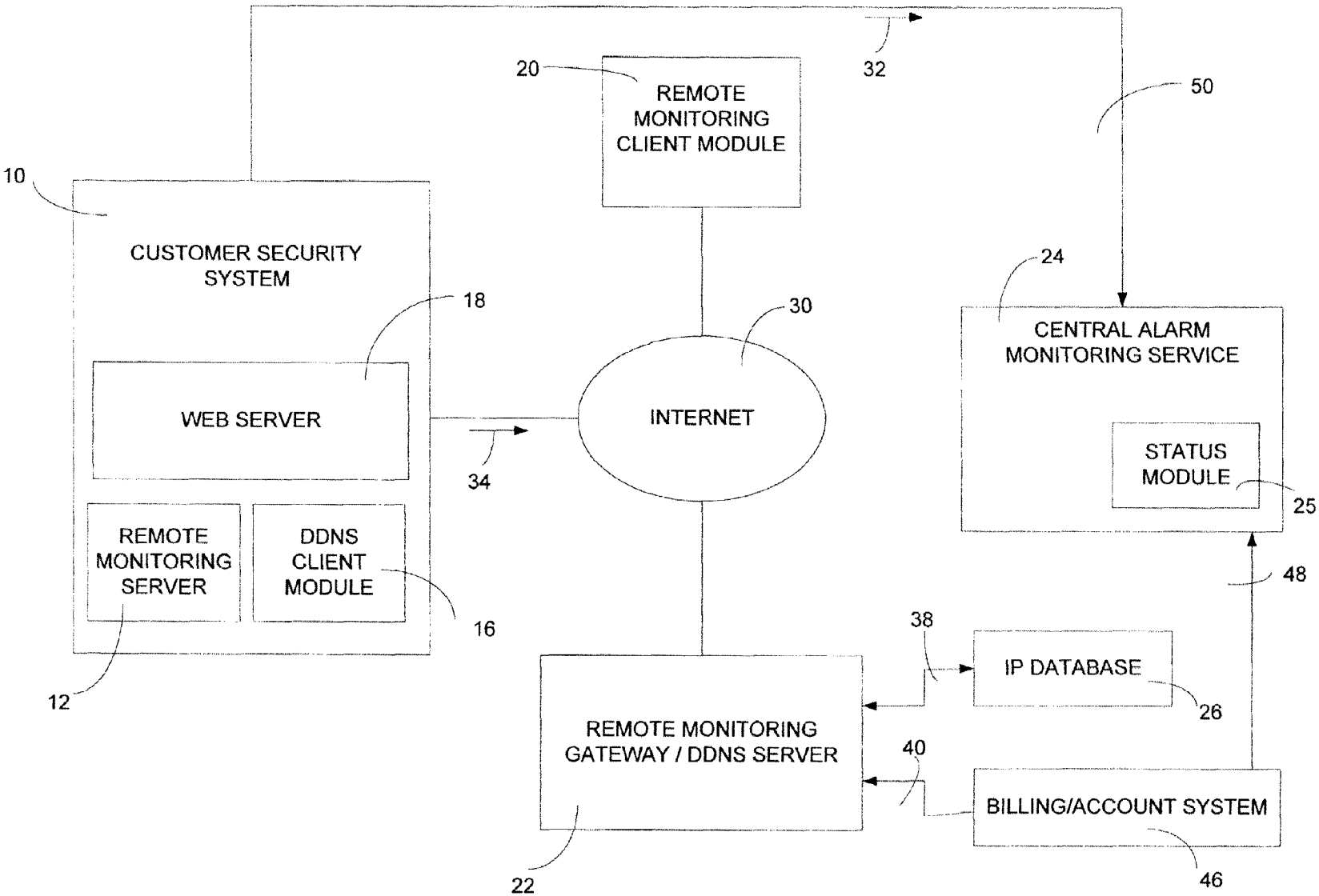
FIG. 3 shows a block diagram of a system for remote monitoring a customer security system using another telecommunication medium than the Internet (ex. cable, wireless or telephone communication) to communicate the status signal to the central alarm monitoring service.

According to another embodiment of the invention, when such a security breach occurs, the customer security systems 10 transmits a security breach indication via another telecommunication medium 50, such as a fixed telephone connection, wireless communication or a cable network communication connection (see FIG. 3). When the central alarm monitoring service 24 receives a security breach indication, it generates an alarm signal as a consequence and transmits it to the security authority.

As abovementioned, the customer security systems 10 comprise a remote monitoring server module 12. The latter comprises security software, such as an end-user management software. The remote monitoring server module 12 is accessible via the Internet for allowing a remote Internet access to a desired customer security system 10 by a given authenticated client. The latter can have such an access using the remote monitoring client module 12. In embodiments using a web server configuration, the client module can be provided by a computer browser loading html pages and/or applets. In connection with the desired customer security system 10, the authenticated client will therefore be able to have a remote monitoring thereof. Alternatively, if the authentication level permits it, the client would be able to remote control the desired one of the customer security systems 10. For instance, the client would be able to remotely program access codes and settings, search, sort and filter saved system events, and to arm or disarm certain zones.

The customer security systems 10 are assigned dynamic IP addresses from their ISP's, as is customary. In order to allow the remote monitoring client module 20 to communicate with the remote monitoring server module 12, an IP address change of the customer security systems 10 is monitored and the current IP address thereof is reported to the remote monitoring client module 20. This can be done in several ways.

A first possible method is to integrate a DDNS client module 16 in the customer security systems 10, which detects an IP address change thereof and communicates the current IP address, using an IP address signal 34, to a DDNS server 22 directly to be stored in an IP address database 26, upon occurrence of such a change. According to a second possible method, the customer security systems 10 periodically transmit an IP address signal 34 comprising the current IP address to be stored in the IP address database 26. According to a first embodiment of the invention (see FIGS. 1 and 2), the IP address signal 34 is first sent to the central alarm monitoring service 24 that stores the current IP address in the IP address database 26 connected thereto. Message 34 from system 10 may also contain status information of the security system, such that the monitoring service 24 is kept current of the status at the same time that server 24 is able to pass on the IP address to database 26.

According to another embodiment of the invention, the IP address signal 34 is sent to be stored in the IP address database 26 using the DDNS server 22 without passing through the central alarm monitoring service 24 (see FIG. 3). The DDNS server 22 in the embodiment of FIG. 3 controls whether a customer has the right to use the DDNS as a function of the client account data 40 from the billing/accounting system 46.

The security system status can be determined as a function of receiving or lack thereof of the IP address signal 34 at the central alarm monitoring service 24. If the signal 34 has not been received, the central alarm monitoring service 24 transmits an alarm signal to the security authority signaling a possible occurrence of a security breach.

The remote monitoring client module 20 is connected to a remote monitoring gateway 22 providing authenticated or unauthenticated dynamic domain name service (DDNS) server functionality to connect the remote monitoring client module 20 to the desired one of the customer security systems 10.

After authenticating the client requesting to communicate with the desired one of the security systems, the remote monitoring gateway 22 accesses the IP address database 26 and retrieves the current IP address 38 in connection with the desired one of the customer security systems 10. The remote monitoring gateway 22 establishes then a communication between the remote monitoring client module 20 and the remote monitoring server module 12 using the retrieved current IP address.

The customer security systems 10 comprise a Web server 18 containing a Web browser and Web pages (or an applet) to permit access to the systems 10.

According to a first embodiment of the invention (see FIGS. 1 and 2), the remote monitoring gateway 22 is connected to an account database 28 for verifying the account status of a given client. It receives an account status signal 40 in connection with a given client. The account database 28 is connected to the central alarm monitoring service 24 to receive and update accounting information 44 about the clients. The remote monitoring gateway takes a decision whether or not to connect the remote monitoring client module 20 to the desired one of the customer security systems 10 as a function of the account status 40 related to the given client. According to another embodiment of the invention (see FIG. 3), the remote monitoring gateway 22 is connected to a billing/account system 46 for billing the remote monitoring clients for using the DDNS service. The Billing data 48 is then transmitted by the billing/account system 46 to the central alarm monitoring service 24 to be processed.

In some embodiments, DDNS may be implemented so as to be a service located on the web at an address specifically for the system 10 in response to which server 22 will redirect the browser 20 to the desired system 10. Such redirecting can be done either at the level of html (namely the server 22 returns a redirect page containing the dynamic IP address for the system 10) or at the IP level (namely the server 22 returns the IP address of the system 10 as the DNS query response). In other embodiments, different configurations are provided. For example, an authenticated login process may be provided before the IP address information is passed from the server 22 to the client 20. Alternatively, the client module 20 can use software without that communicates with the system 10 without using http, and the client module 20 can query server 22 to obtain the IP address of the system 10 contained in database 26 in any suitable manner. While these other mechanisms for connecting the client to a server having a dynamic IP address may not conventionally be referred to as a DDNS server or system, it is to be understood within the scope of the present description that such alternatives provide DDNS.

The invention claimed is:

1. A system for remote monitoring a plurality of security systems coupled to the Internet, said security systems being assigned dynamic IP addresses, each of said security systems comprising a remote monitoring server module, the system comprising:

a central alarm monitoring service coupled to the Internet for periodically communicating with said plurality of security systems and determining a status thereof to generate an alarm signal as a function of said status, said alarm monitoring service storing a current IP address of said plurality of security systems in an IP address database;

a remote monitoring gateway providing authenticated or unauthenticated dynamic domain name service (DDNS) server functionality to couple a given remote monitoring client to a desired one of said security systems, said gateway being coupled to said IP address database and to the Internet; and an account database coupled to said gateway for verifying an account status of said remote monitoring client, said gateway taking a decision whether or not to couple said remote monitoring client to said desired one of said security systems as a function of said account status.

2. A system as claimed in claim 1, wherein said plurality of security systems further comprise a status push module, said communicating is carried out by periodically transmitting from said status push module to said central alarm monitoring service a status signal in connection with said plurality of security systems, and said determining said status is carried out at said central alarm monitoring service as a function of said received status signal.

3. A system as claimed in claim 1, wherein said plurality of security systems further comprise a DDNS client module to detect a change of said dynamic IP address upon occurrence, said plurality of security systems transmitting, upon occurrence of said change, said current IP address to said central alarm monitoring service.

4. A system as claimed in claim 1, wherein said plurality of security systems transmit periodically a signal comprising said current IP address to said central alarm monitoring service.

5. A system as claimed in claim 4, wherein said determining said status is carried out as a function of receiving or lack thereof of said signal at said central alarm monitoring service.

6. A system as claimed in claim 1, wherein said remote monitoring server module comprises a Web server for accessing said security systems.

7. A system as claimed in claim 1, further comprising a plurality of remote monitoring client modules associated with said plurality of remote monitoring clients, said remote monitoring client modules being coupled to the Internet for accessing said security systems.

8. A method of remote monitoring a plurality of security systems coupled to the Internet, said security systems being assigned dynamic IP addresses, said security systems including a remote monitoring server module, the method comprising:

providing a central alarm monitoring service coupled to the Internet for periodically communicating with said plurality of security systems and determining a status thereof to generate an alarm signal as a function of said status, said alarm monitoring service storing a current IP address of said plurality of security systems in an IP address database;

providing a remote monitoring gateway providing authenticated or unauthenticated dynamic domain name service (DDNS) server functionality to couple a given remote monitoring client to a desired one of said security systems, said gateway being coupled to said IP address database and to the Internet; and verifying an account status of said remote monitoring client and taking a decision whether or not to couple said remote monitoring client to said desired one of said security systems as a function of said account status.

9. A method as claimed in claim 8, further comprising billing said remote monitoring client for providing said dynamic domain name service.

10. A system for remote monitoring a plurality of security systems coupled to the Internet, said security systems being assigned dynamic IP addresses, each of said security systems comprising a remote monitoring server module, the system comprising:

a billing module storing client account data;

a central alarm monitoring service module coupled to said billing module for receiving said client account data, said module using said account data for control of said alarm monitoring; and a remote monitoring gateway providing authenticated or unauthenticated dynamic domain name service (DDNS) server functionality to couple a given remote monitoring client among said plurality of remote monitoring clients to a desired one of said security systems, where said gateway is coupled to the Internet and to an IP address database storing a current IP address associated with each one of said plurality of security systems, said gateway being coupled to said billing module to receive said client account data, said gateway using said client account data to control said DDNS.

11. A system as claimed in claim 10, wherein said plurality of security systems further comprise a status push module, said communicating is carried out by periodically transmitting from said status push module to said central alarm monitoring service a status signal in connection with said plurality of security systems, and said determining said status is carried out at said central alarm monitoring service as a function of said received status signal.

12. A system as claimed in claim 10, wherein said plurality of security systems further comprise a DDNS client module to detect a change of said dynamic IP address upon occurrence, said plurality of security systems transmitting, upon occurrence of said change, said current IP address to said central alarm monitoring service.

13. A system as claimed in claim 10, wherein said plurality of security systems transmit periodically a signal comprising said current IP address to said central alarm monitoring service.

14. A system as claimed in claim 10, wherein said determining said status is carried out as a function of receiving or lack thereof of said signal at said central alarm monitoring service.

15. A system as claimed in claim 10, wherein said remote monitoring server module comprises a Web server for accessing said security systems.

16. A system as claimed in claim 10, further comprising a plurality of remote monitoring client modules associated with said plurality of remote monitoring clients, said remote monitoring client modules being coupled to the Internet for accessing said security systems.

* * * * *